US006637996B1

(12) United States Patent
Hayakawa et al.

(10) Patent No.: US 6,637,996 B1
(45) Date of Patent: Oct. 28, 2003

(54) BOOKBINDING APPARATUS, ADHESIVE CARTRIDGE, AND IMAGE FORMING APPARATUS

(75) Inventors: Yasuyoshi Hayakawa, Mishima (JP); Tsuyoshi Waragai, Mishima (JP); Tomoyuki Araki, Numazu (JP); Atsushi Ogata, Shizuoka-ken (JP); Masayoshi Fukatsu, Shizuoka-ken (JP); Junichi Sekiyama, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 186 days.

(21) Appl. No.: 09/666,881

(22) Filed: Sep. 20, 2000

(30) Foreign Application Priority Data

Sep. 22, 1999 (JP) ..... 11-268718

(51) Int. Cl.[7] ..... B42C 11/00

(52) U.S. Cl. ..... 412/9; 206/411; 270/58.08; 412/1; 412/37; 412/902; 493/334

(58) Field of Search ..... 412/1, 9, 18, 19, 412/22, 33, 37, 900, 901, 902; 206/389, 411; 270/58.08; 493/334, 384

(56) References Cited

U.S. PATENT DOCUMENTS 5,140,380 A * 8/1992 Nakamura et al. ..... 270/58.05
5,569,011 A * 10/1996 Yamaguchi et al. ..... 412/33
5,569,012 A * 10/1996 Kosasa et al. ..... 412/33
5,632,853 A * 5/1997 Montandon et al. ..... 118/257
5,735,659 A * 4/1998 Kosasa et al. ..... 412/11
5,752,154 A * 5/1998 Maruyama et al. ..... 270/52.01
5,833,423 A * 11/1998 Yamaguchi et al. ..... 412/33
5,854,957 A * 12/1998 Morikawa ..... 399/38
6,099,225 A * 8/2000 Allen et al. ..... 412/1
6,259,887 B1 * 7/2001 Awano ..... 399/390

FOREIGN PATENT DOCUMENTS

JP 2001088486 * 4/2001

* cited by examiner

*Primary Examiner*—Monica Carter
(74) *Attorney, Agent, or Firm*—Fitzpatrick, Cella, Harper & Scinto

(57) ABSTRACT

The present invention relates to a bookbinding apparatus attached to face to an end face of a sheet bundle where the sheet bundle is formed of collected sheets on which images are formed by an image forming apparatus. The bookbinding apparatus comprises a container detachably attached to a body of the bookbinding apparatus and an adhesive sheet on a surface of which a hot melt type adhesive to be melt by a heating means is coated, the adhesive sheet being contained in the container as in a state that the adhesive sheet is wound in a roll shape.

11 Claims, 9 Drawing Sheets

(a)

(b)

BOOKBINDING APPARATUS, ADHESIVE CARTRIDGE, AND IMAGE FORMING APPARATUS

BACKGROUND OF THE INVENTION

1. Field of the Invention

This invention relates to a bookbinding apparatus mounted in an image forming apparatus such as a laser beam printer or the like to deliver recorded sheets a after the recorded sheets are stacked and bound, an adhesive cartridge, and an image forming apparatus using the bookbinding apparatus.

2. Description of Related Art

As bookbinding apparatuses for image forming apparatuses such as laser beam printers or the like, there are apparatuses in which the sheets are delivered after the recorded sheets are stacked in the prescribed number and bound upon fastened by staplers at an end of the sheet bundle.

With the above bookbinding apparatus in which bookbinding is made with staplers, however, there raise problems such that the sheets require some margin for stapling, that the book is not easily opened after bound, that the appearance is not beautiful because staples appear on the surface, and that the end of the bound sheets is turned up.

As a bookbinding apparatus to solve the above problems, there is a bookbinding apparatus in which an end face of the sheets is adhered, or bound with so-called paste. For adhesive used in the bookbinding apparatus using such a paste, hot melt type adhesive is generally used.

Such bookbinding apparatuses for bookbinding in use of hot melt type adhesive can be categorized into two major types.

The first type is to make bookbinding in application of adhesive to the end of a sheet bundle to be bound with a coating roller or the like after the adhesive is melt by heating an entire adhesive pan with a heater arranged at the apparatus where the adhesive is placed in the adhesive pan capable of storing adequate adhesive for adhering sheets.

The second type is to make bookbinding by melting adhesive with a heater after adhesive is coated in advance on a cover sheet of a folio and then the sheet bundle is sandwiched by the cover sheet.

However, with the first type bookbinding apparatus, there raises a problem that it is difficult to handle hot melt type adhesive and therefore maintenance of the apparatus becomes very bad. In addition, excessive electric power is required to melt the adhesive, and therefore, there raises a problem that the apparatus consumes too much electric power for mounted as a bookbinding apparatus as an option of a printer or the like.

With the second bookbinding apparatus, there is a problem that the book cover to be used has to be selected in accordance with the thickness of the sheet bundle to be bound, and that the book cover has to be prepared in accordance with the thickness of the sheet bundle expected to be bound. Setting of the book cover is not easy, and the second bookbinding apparatus, as an option of a printer or the like, has a problem in controllability, costs, and maintenance property.

SUMMARY OF THE INVENTION

This invention is made to solve the above problems and characterized in that, in a bookbinding apparatus stacking every prescribed number of sheets on which images are formed by an image forming apparatus and coating hot melt type adhesive on an end face of the stacked sheet bundle upon softening the adhesive by heating means, an adhesive sheet on which the hot melt type adhesive is coated is wound and formed into a roll shape to be contained in a container, which is detachably attached to a bookbinding apparatus body.

In another bookbinding apparatus stacking every prescribed number of sheets on which images are formed by an image forming apparatus and coating hot melt type adhesive on an end face of the stacked sheet bundle upon softening the adhesive by heating means, an adhesive sheet coated with the hot melt type adhesive, wound, and formed into a roll shape, and the heating means for heating and melting the sheet on which the adhesive is coated are contained in a single container, which is detachably attached to a bookbinding apparatus body.

BRIEF DESCRIPTION OF THE DRAWINGS

FIG. 2(*b*) is a cross section of an inserting portion on an apparatus body side of the adhesive sheet cartridge according to the first embodiment of the invention;

DETAILED DESCRIPTION OF PREFERRED EMBODIMENTS

Hereinafter, embodiments of the invented bookbinding apparatus are described.

First Embodiment

Figure 1:
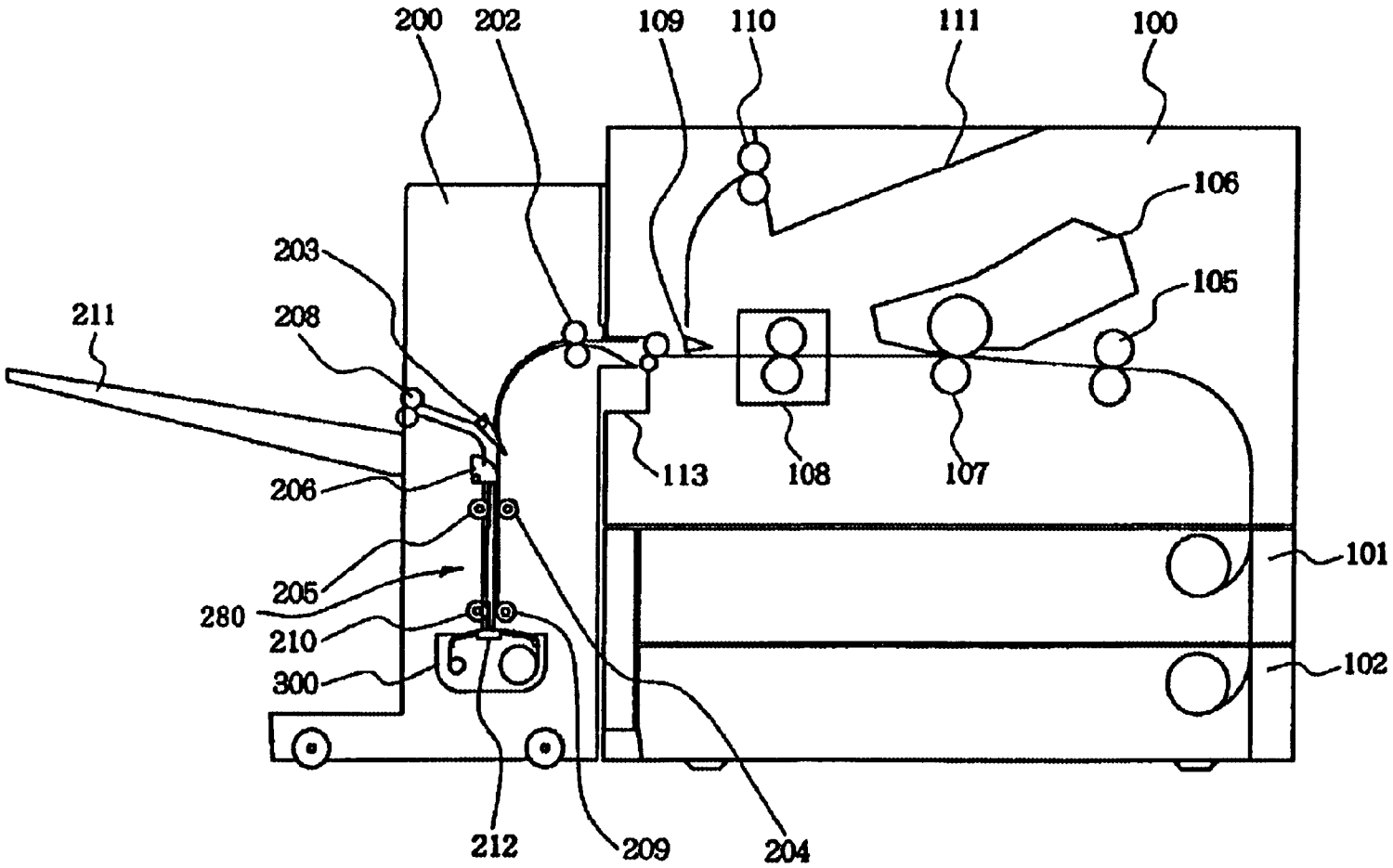
FIG. 1 is a whole cross section showing a printer to which a bookbinding apparatus according to the invention is mounted.

FIG. 1 shows a cross section of a whole printer apparatus to which the invented ,bookbinding apparatus is mounted. Numeral 100 is a printer apparatus body; numeral 200 is a bookbinding apparatus according to the invention.

Now, the entire apparatus is described along a conveyance route of the sheets. A sheet P supplied sheet by sheet selectively from sheet cassettes 101, 102 is conveyed to an image forming section made of an image forming process cartridge 106, a transfer roller 107, and the like at a prescribed timing by means of a register roller 105, and thereby, desired images are recorded on a top of the sheet P. Subsequently, the recorded images are fixed by a fixing unit 108.

Numeral 109 is a flapper provided at a branching off point between a facing down delivery stacking portion 111 via ejecting rollers 110 for delivering and stacking sheets whose recording surfaces are faced down upon reversing the sheets and a facing up delivery portion 113 for delivering the sheets whose recording surfaces are placed as they are, for sharing the sheets P to either ways.

The bookbinding apparatus 200 is installed to be capable of loading sheets P from the facing down delivery portion 113 of the printer 100, and the connection state between the printer apparatus 100 and the bookbinding apparatus 200 is always monitored by a communicating means. When the printer 100 is not connected with the bookbinding apparatus 200, a display or indicator of the printer apparatus shows such disconnection state, and the communication means sends such information to a controller.

When the apparatus receives an instruction to bookbinding operation while the bookbinding apparatus 200 is connected with the printer apparatus 100, the flapper 109 moves toward the facing up delivery portion 113, thereby delivering sheets to the bookbinding apparatus 200.

The sheets P conveyed to the facing up delivery portion 113 of the printer apparatus body are conveyed to an inlet roller 202 of the bookbinding apparatus 200 and loaded into the bookbinding apparatus 200.

In the bookbinding apparatus 200, the loaded sheets P are fed and stacked as they are at the bookbinding section located on a lower side in FIG. 1. Numeral 203 is a flapper and is urged pivotably as to always seal the conveyance route with weak urging force. When the sheets P are loaded from the inlet roller 202, the flapper 203 opens the conveyance route upon moving pivotally in opposing to the urging force according to conveyance force of the sheet P, thereby guiding the sheet P to the alignment portion located on a lower side. Numeral 206 is a sheet loading guide, urged in a clockwise direction by an urging means, not shown, and engaged at a position shown in FIG. 1 by an engagement member, not shown. When the sheet P is loaded, the sheet P is pushed to a right end of the conveyance route in FIG. 1 by the sheet loading guide 206 and is conveyed.

Numerals 204, 205, 209, and 210 are alignment rollers, which can individually be rotated and controlled to move. The alignment rollers 204, 209 are shifted in the right direction in FIG. 1 right before the sheet P is loaded, thereby controlling the conveyance route of the sheet P to be wide. When loading is finished, the rollers are then shifted to the left side in FIG. 1, the rollers, with the opposing rollers 205, 210, hold the sheet bundle with a prescribed pushing force, thereby forming a sheet bundle forming means 280. With this operation, the sheets P to be stacked are aligned according to the page order from the left side in FIG. 5 and then stacked.

A sheet on which a hot melt type adhesive, as described below, is coated is disposed on a lower side face of the sheet bundle upon supported on a heating surface of the area heater 212. When a sheet bundle of a prescribed number of sheets is placed thereon, the area heater 212 is heated to melt the hot melt type adhesive to adhere the stacked sheet bundle. Subsequently, after a prescribed cooling period of time is given, the bound sheet bundle is conveyed by reverse driving of the rollers 204, 205, 209 and 210. The sheet loading guide 206 at that time escapes in rotating in the counterclockwise direction at a tip of the sheet bundle in opposing to the urging force. Then, the sheet bundle is guided by the flapper 203 to ejecting rollers 208 and the delivery tray 211 and is stacked in a manner that the bound sheet bundles face down with the recording sides down.

Figure 2:
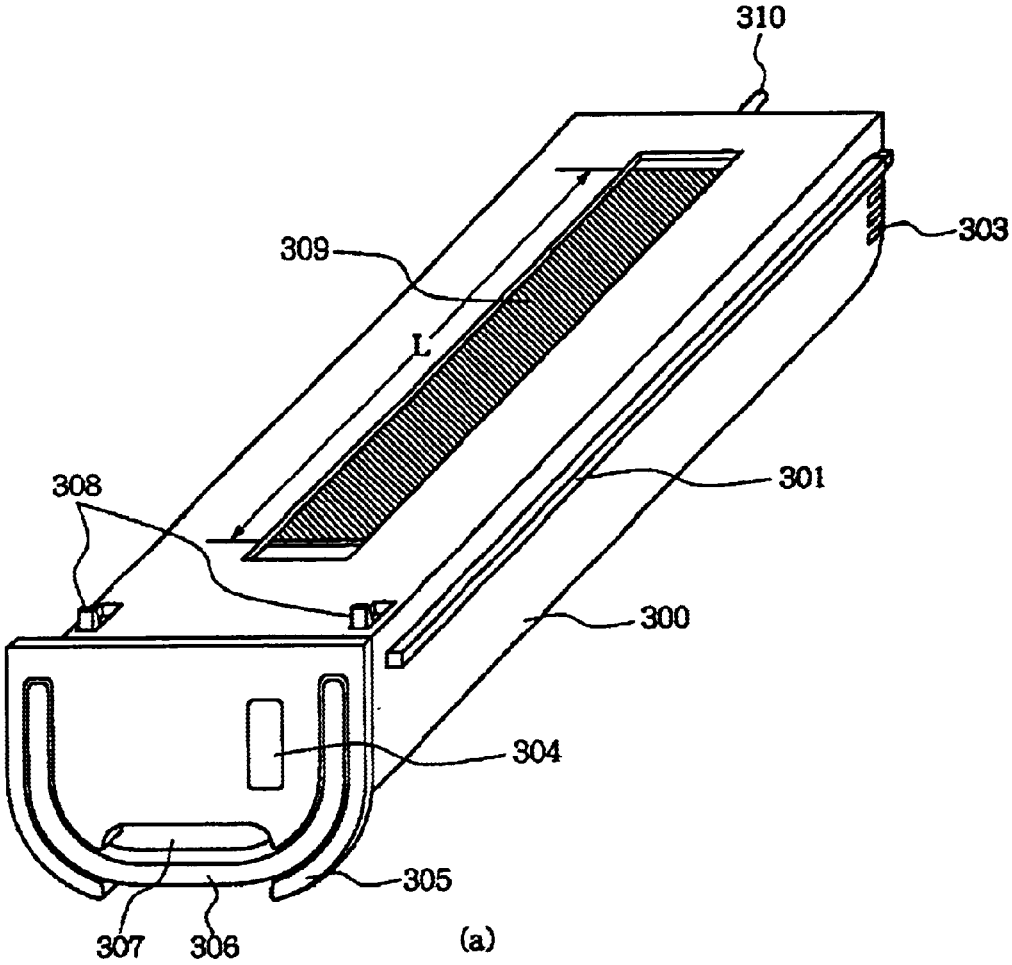
FIG. 2(*a*) is a perspective view of an adhesive sheet cartridge according to the first embodiment of the invention.
Figure 2:
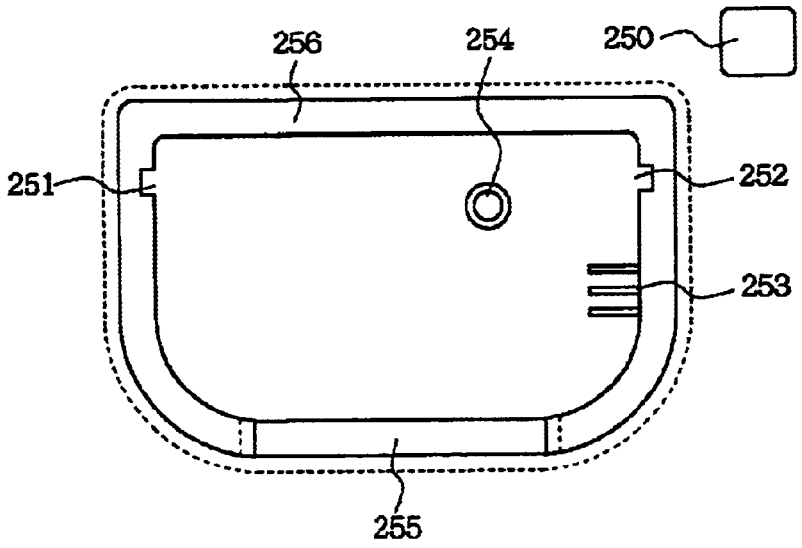
Figure 3:
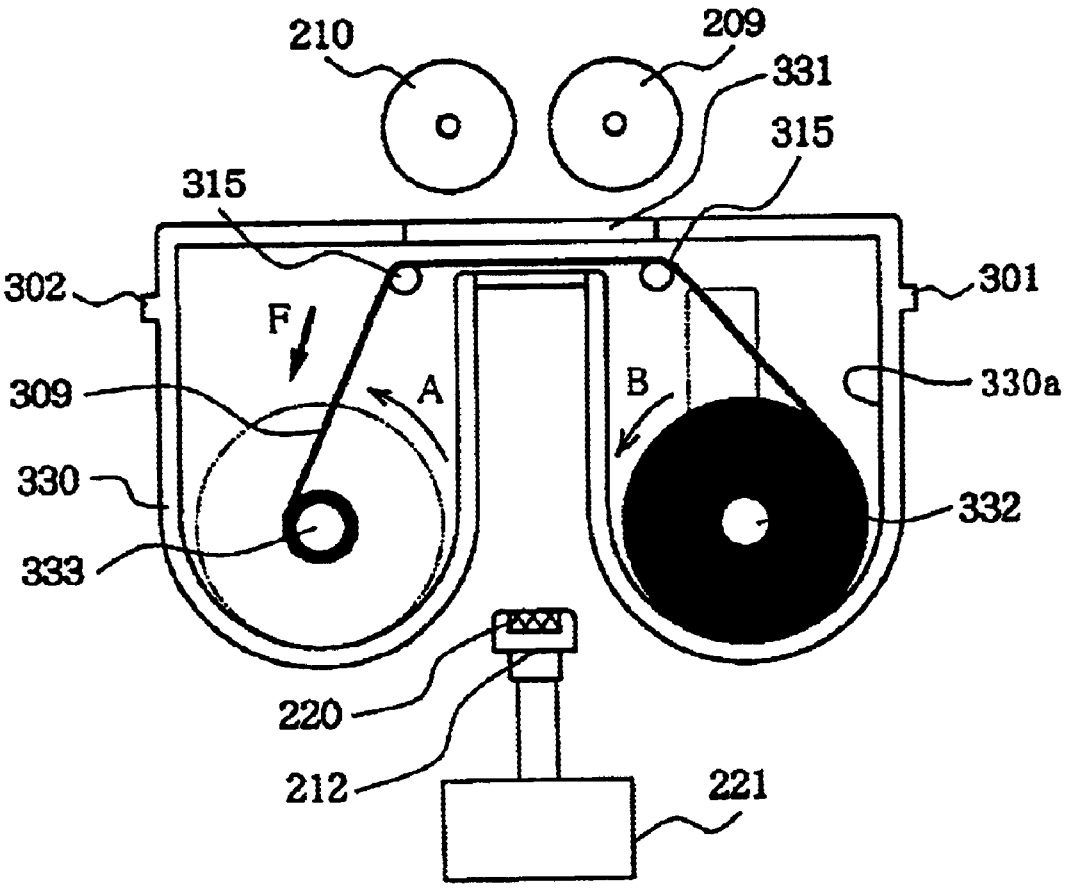
FIG. 3 is a cross section of the adhesive sheet cartridge according to the first embodiment of the invention where a heater is in a power-off state.
Figure 4:
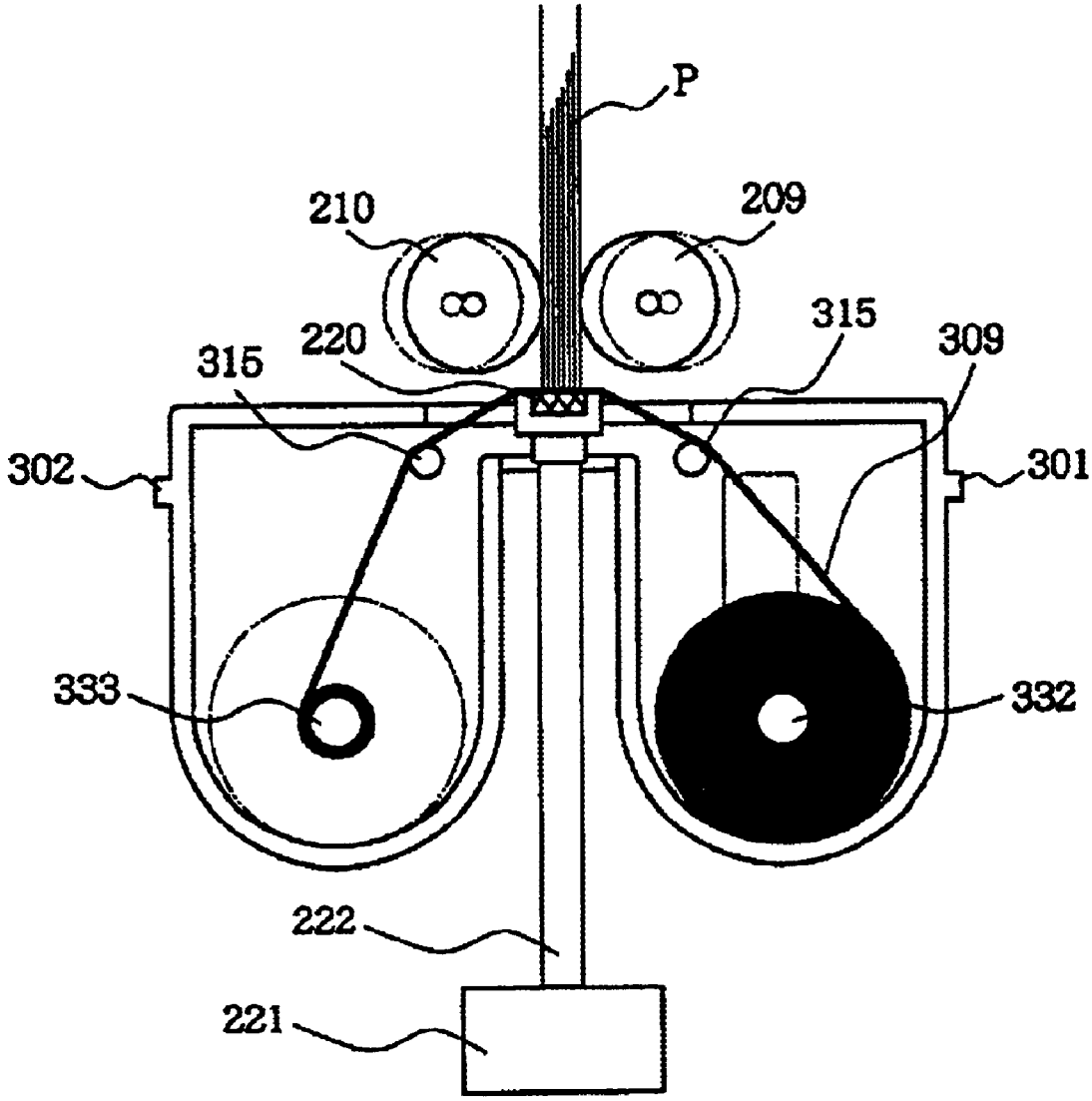
FIG. 4 is a cross section of the adhesive sheet cartridge according to the first embodiment of the invention where the heater is in a bookbinding operation state.

Numeral 300 is an adhesive sheet cartridge, and the structure thereof is described in detail based on the drawings. FIG. 2(*a*) is a perspective view of this adhesive sheet cartridge; FIG. 2(*b*) shows an inlet of the bookbinding apparatus body. FIG. 3 is a cross section of the adhesive sheet cartridge according to the first embodiment of the invention where a heater is in a power-off state; FIG. 4 is a cross section of the adhesive sheet cartridge according to the first embodiment of the invention where the heater is in a bookbinding operation state.

In FIG. 3, numeral 309 is an adhesive sheet on the surface of which a hot melt type adhesive is coated, wound in a roll shape on a first rotary shaft 332, and contained in a cartridge container 330. The adhesive sheet is a synthetic resin sheet made of a base sheet having adequate heat resistance and an adhesive layer formed on the surface of the base sheet. The adhesive is made of a material that can be melt at a prescribed temperature (around 130° C. in this embodiment), and has a structure that when the heater 212 heats a portion from the back side the corresponding portion comes to melt.

The adhesive sheet 309 wound in the roll shape is contained in a first containing portion 330*a* located on a right side of the cartridge container 330. An end of the adhesive sheet is wound on a second rotary shaft 333 in a second containing portion 330*b* located on a left side of the cartridge container 330 via a pinch roller 315 held rotatively. The second rotary shaft 333 is rotatable only in the counterclockwise direction (direction of arrow A) by a one-way clutch not shown, and the first rotary shaft 332 is always given with rotation force in the clockwise direction (direction of arrow B) in a prescribed urging force F where the adhesive sheet 309 is wound on the second rotary shaft 333. Accordingly, the adhesive sheet 309 is without loosely held by prescribed tension between the first rotary shaft 332 and the second rotary shaft 333.

Numeral 331 is an opening. When bookbinding operation is made, the heater portion 212 for melting the hot melt type adhesive coated on the adhesive sheet from the lower side can project as shown in FIG. 4 in overcoming the sheet tension. When the bookbinding work starts, the heater portion 212 located at the escaping position moves up by means of the extendable arm 222, and as shown in FIG. 4, the heater portion 212 moves to the bookbinding position ion pushing up the adhesive sheet 309 from the heater control unit 221. Subsequently, when sheets in a predetermined number are stacked, the adhesive sheet 309 comes to contact with a position corresponding to the spine of the sheet bundle, and the area heater 220 of the heater portion 212 is powered to heat and melt the hot melt type adhesive portion of the adhesive sheet 309 at about 130° C., thereby coating the adhesive on the end surface of the sheet bundle. At that time, the plural sheets are held in the vertical direction, and this forms a sheet bundle forming means 280. The sheet bundle forming means 280 includes, as described above, the upper rollers 204, 205 and the lower rollers 209, 210, which maintain the bound state in pressing in the thickness direction the sheets held in a plural number. In this state, because an end face (or the spine) of the sheet bundle is pressed by the self-weight to the adhesive sheet 309, the adhesive is smoothly impregnated into the end face of the sheet bundle where the adhesive sheet 309 is heated to melt the adhesive on the surface of the adhesive sheet, and bookbinding is made by surely securing the end face of the sheets upon hardening of the adhesive. After the adhesive is coated on the sheet bundle upon heating for a predetermined time, the sheet bundle is nipped by the rollers 204, 205, 209, and 210 and conveyed to deliver the bundle to the delivery tray 211 described above. When bookbinding of the sheet bundle ends, the adhesive sheet 309 is taken up on the second rotary shaft 333 by the predetermined distance so that the new hot melt type coating surface comes on the heater surface, thereby enabling the subsequent sheet bundle to be bound.

Figure 5:
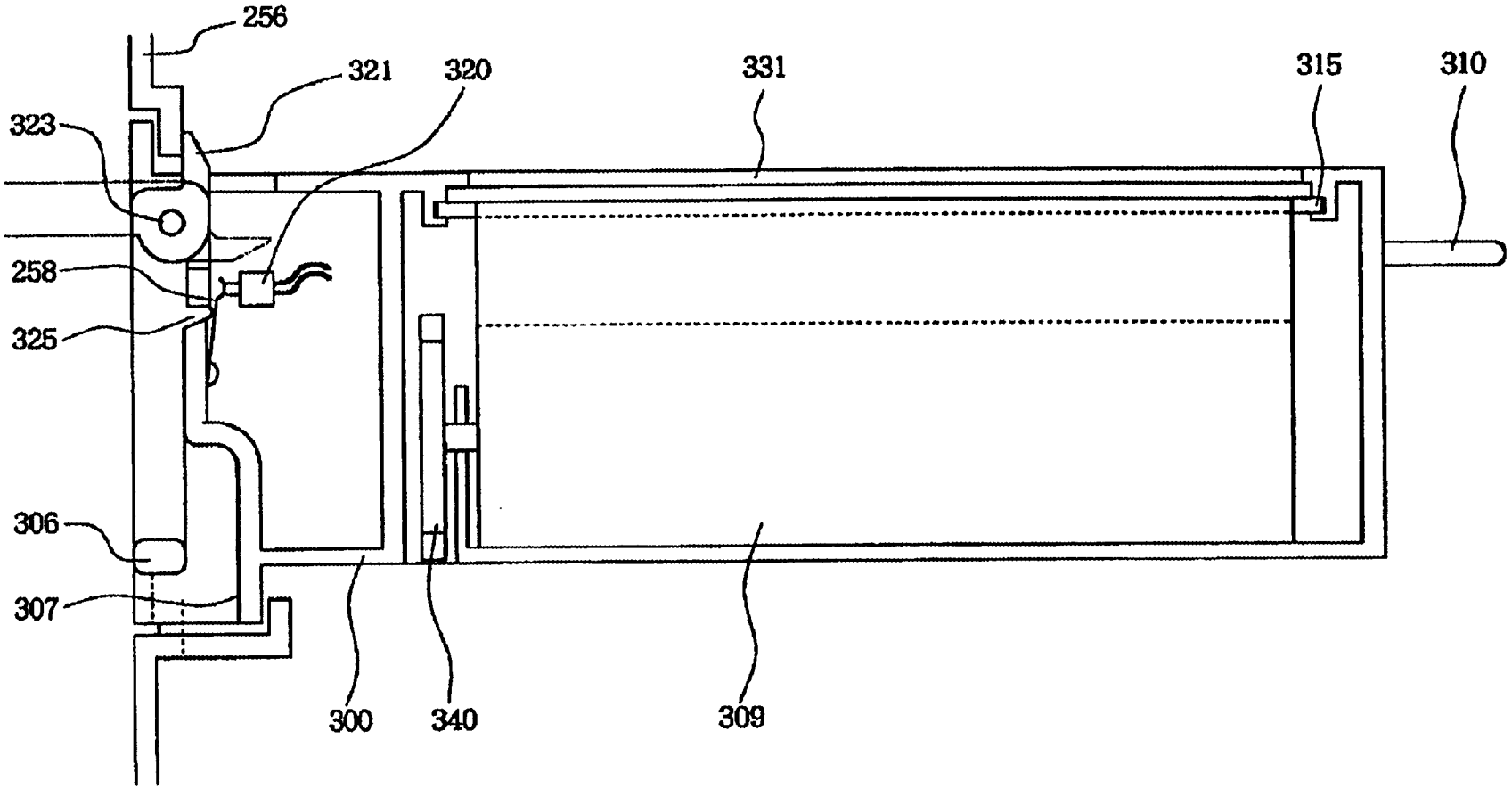
FIG. 5 is a cross section in a longitudinal direction of the adhesive sheet cartridge according to the first embodiment of the invention.

Numerals 251, 252 are insertion guide grooves of the adhesive sheet cartridge 300 formed on the bookbinding apparatus body. When the adhesive sheet cartridge 300 is inserted in the apparatus, ribs 301, 302 allow the cartridge 300 to be inserted smoothly in aid of the insertion guide grooves 251, 252. Numeral 304 is a window to make the remaining amount of the roll recognized directly with eyes. Numeral 306 is a grip, which is pivotally movable around a pivot center 323 as shown in FIG. 5. When the adhesive sheet cartridge 300 is detached and attached, the grip 306 is moved to be about horizontal, thereby allowing the adhesive sheet cartridge 300 to be pulled out.

An engagement portion 321 is formed around the pivot center 323 of the grip 306. This engagement portion 321 is an engagement member for rendering the adhesive sheet cartridge 300 locked to the bookbinding apparatus body. When the grip 306 is set approximately in a vertical position as shown in FIG. 5 where the adhesive sheet cartridge 300 is inserted in the bookbinding apparatus body, the grip 306 is locked to a cover 256 of the bookbinding apparatus body. At that time, an outer surface 305 of the adhesive sheet cartridge 300 forms the same surface as the outer surface of the bookbinding apparatus body.

Numeral 325 is a projecting member to turn on a switch 320. When the grip 306 is set, the switch 320 is turned on automatically. The switch 320 is an interlock switch, and if the switch is not turned on, the bookbinding apparatus does not begin operating.

As described above, the bookbinding operation can be done easily by structuring the apparatus to be used with the sheet, on which the hot melt type adhesive used for bookbinding in an image forming apparatus such as a printer, contained in the cartridge 300 in the form of the roll.

Second Embodiment

Figure 6:
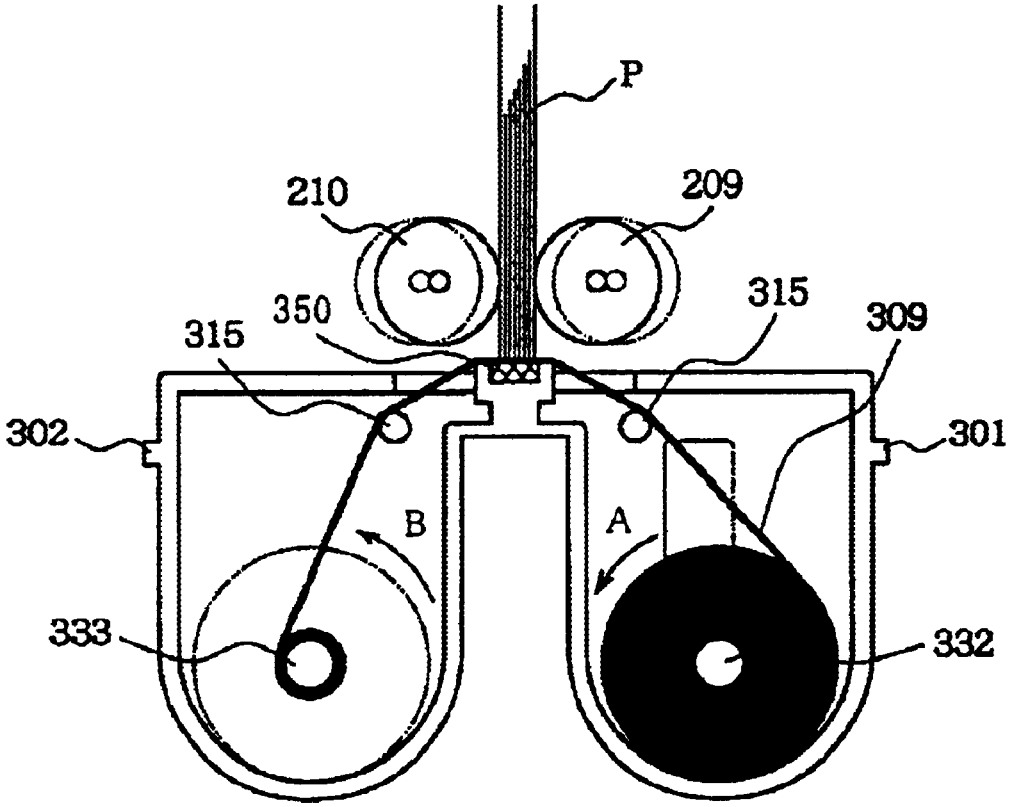
FIG. 6 is a cross section of an adhesive sheet cartridge according to the second embodiment of the invention.
Figure 7:
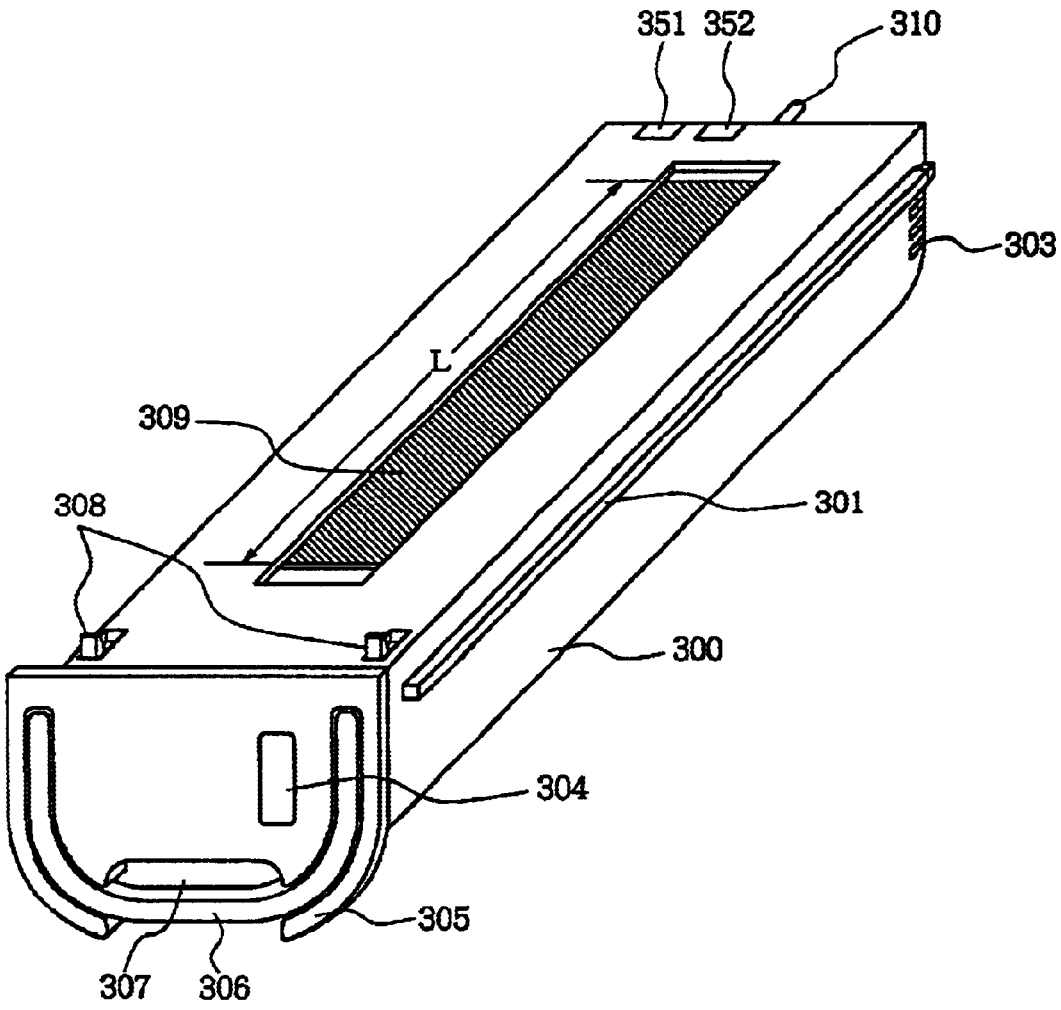
FIG. 7 is a perspective view of an adhesive sheet cartridge according to the second embodiment of the invention.

FIG. 6 and FIG. 7 are diagrams showing a structure of the adhesive sheet cartridge in a bookbinding apparatus according to the second embodiment of the invention. In the above first embodiment, the heater portion 212 for melting the adhesive on the adhesive sheet during bookbinding is disposed in the bookbinding apparatus body and structured to be retractable by means of the heater control unit 221, but in the second embodiment, an area heater 350 as a heater is in the body of the adhesive sheet cartridge 300.

In FIG. 7, numerals 351, 352 are contact points for heater, and the apparatus body can supply the power upon connecting a connector not shown with a power supply of the apparatus body where the adhesive sheet cartridge 300 is inserted in the bookbinding apparatus body. With the structure of the second embodiment, the heater control unit 21 is not required in the bookbinding apparatus body, so that the costs of the whole apparatus can be reduced.

Third Embodiment

Figure 8:
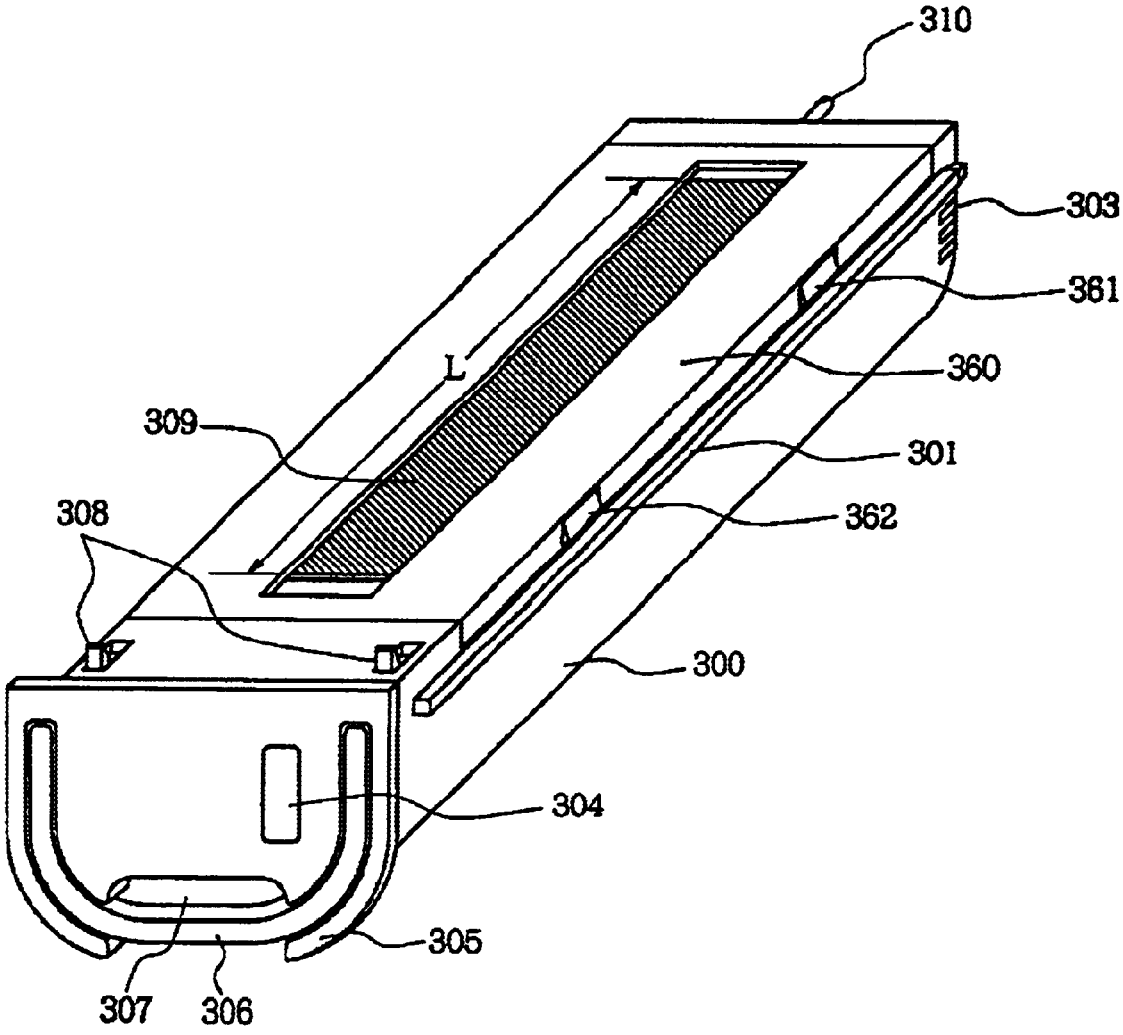
FIG. 8 is a perspective view of an adhesive sheet cartridge according to the third embodiment of the invention.
Figure 9:
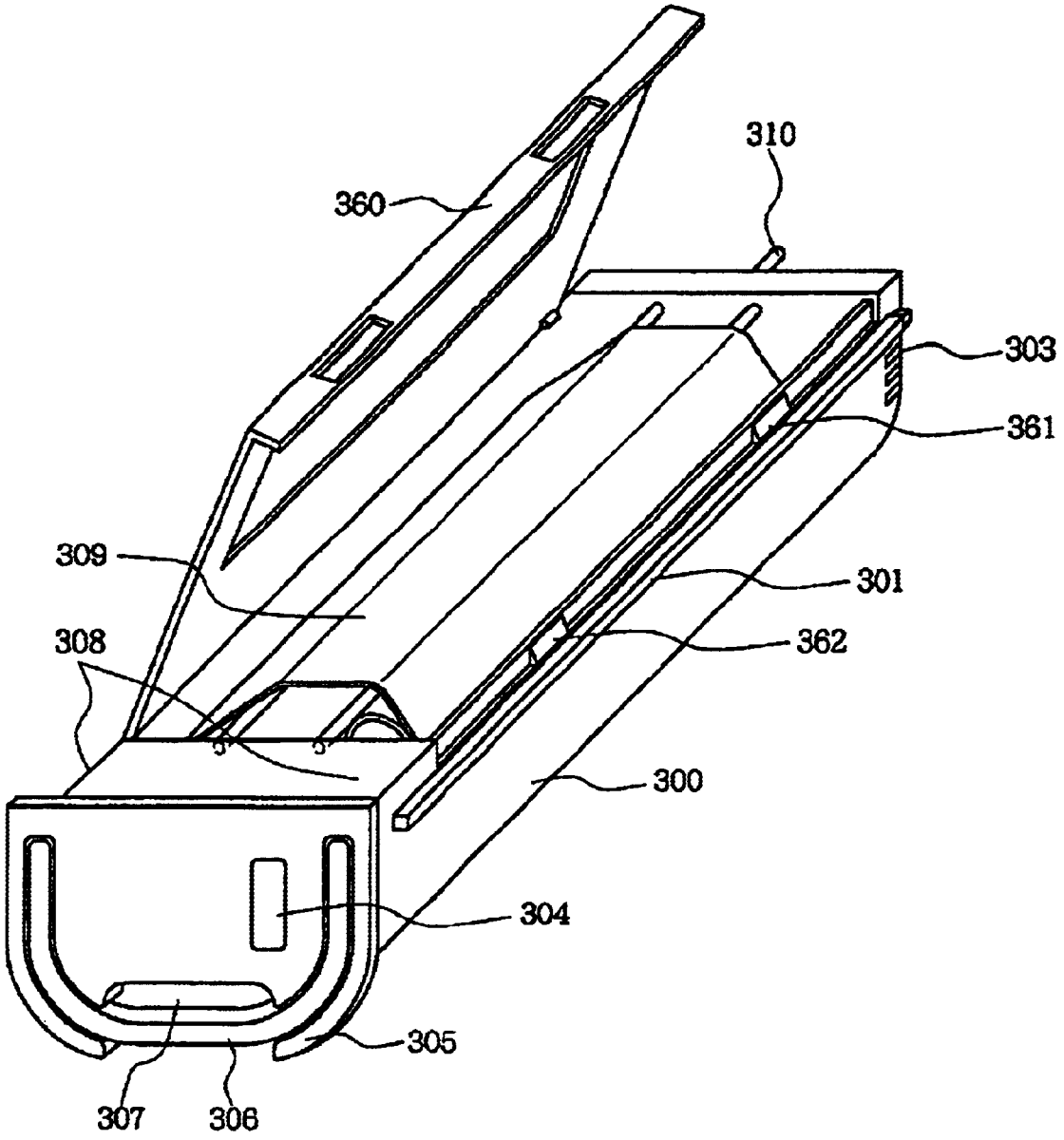
FIG. 9 is a perspective view of an adhesive sheet cartridge according to the third embodiment of the invention where an openable lid is in an open state.

FIG. 8 and FIG. 9 are diagrams showing the structure of an adhesive sheet cartridge according to the third embodiment of the invention.

In FIG. 8, numeral 360 is an openable lid. The openable lid 360 is normally engaged with the adhesive sheet cartridge 300 by a hinge portion not shown and engagement portions 361, 362. Where the engagement portions 361, 362 are disengaged, the openable lid 360 can be opened as shown in FIG. 8, so that the adhesive sheet 309 located inside can be replaced upon taken out of there.

As described above, when the adhesive sheet 309 in the adhesive sheet cartridge 300 is used up, the replacement can be made only with a new adhesive sheet, so that the adhesive sheet cartridge can be provided with excellent economical usage.

According to the invented bookbinding apparatus, by the structure of the detachable cartridge to the bookbinding apparatus where the hot melt type adhesive, most difficult to handle, is coated on a sheet and wound in the roll shape to be contained in the container, the bookbinding apparatus can improve the controllability and allow the bookbinding operation with adhesive even in a compact apparatus, which is otherwise implemented only with a large size apparatus.

Moreover, the invented bookbinding apparatus allows to melt the adhesive in a proper amount when used and to reduce the required heat capacity of the heater.

Furthermore, by containing the adhesive sheet in the cartridge, the bookbinding apparatus makes the maintenance of the apparatus easy, so that users can replace the cartridge and the adhesive sheet easily.

What is claimed is:

1. A bookbinding apparatus for coating, on an end face of a sheet bundle, a hot melt type adhesive upon softening the hot melt type adhesive to make bookbinding, comprising:

a container detachably attached to a body of said bookbinding apparatus;

a first rotary shaft and a second rotary shaft which are attached inside the container;

an adhesive sheet on a surface of which a hot melt type adhesive is coated, the adhesive sheet being contained where wound around the first rotary shaft in a roll shape and being wound on the second rotary shaft; and heating means disposed between the first rotary shaft and the second rotary shaft for transferring the adhesive by heating the adhesive sheet to the end face of the sheet bundle in contact with the adhesive sheet.

2. The bookbinding apparatus according to claim 1, wherein the bookbinding apparatus is mounted to an image forming apparatus and makes bookbinding of collected sheet sheets on which images are formed by the image forming apparatus.

3. The bookbinding apparatus according to claim 1 or 2, wherein the heating means is formed in the body of the bookbinding apparatus.

4. The bookbinding apparatus according to claim 1 or 2, wherein the heating means is formed in a part of the container.

5. An adhesive cartridge for containing an adhesive sheet for a bookbinding apparatus for coating, on an end face of a sheet bundle, a hot melt type adhesive upon softening the hot melt type adhesive to make bookbinding, comprising:

a first rotary shaft on which the adhesive sheet is wound in a roll shape;

a second rotary shaft capable of engaging with an end of the adhesive sheet for winding the adhesive sheet; and a container formed with a first containing portion capable of containing the first rotary shaft and a second containing portion capable of containing the second rotary shaft and detachably attached to the body of the bookbinding apparatus.

6. The adhesive cartridge according to claim 5, further comprising a heating means formed between the first containing portion and the second containing portion of the container.

7. An image forming apparatus for forming an image on a sheet, comprising:

recording means for recording an image on the sheet;

sheet bundle forming means for collecting a plurality of sheets on which the image or images are formed; and a bookbinding apparatus for coating, on an end face of a sheet bundle placed on the sheet bundle forming means, a hot melt type adhesive upon softening the hot melt type adhesive to make bookbinding, comprising:

a container detachably attached to a body of the bookbinding apparatus;

a first rotary shaft and a second rotary shaft which are attached inside the container;

an adhesive sheet on a surface of which a hot melt type adhesive is coated, the adhesive sheet being contained where wound around the first rotary shaft in a roll shape and being wound on the second rotary shaft; and heating means disposed between the first rotary shaft and the second rotary shaft for transferring the adhesive by heating the adhesive sheet to the end face of the sheet bundle in contact with the adhesive sheet.

8. The bookbinding apparatus according to claim 7, wherein said heating means is formed in the body of the bookbinding apparatus.

9. The bookbinding apparatus according to claim 7, wherein said heating means is formed in a part of the container.

10. An adhesive cartridge for containing an adhesive sheet for a bookbinding apparatus for coating, on an end face of a sheet bundle, a hot melt type adhesive upon softening the hot melt type adhesive to make bookbinding, comprising:

a first rotary shaft on which the adhesive sheet is wound in a roll shape;

a second rotary shaft capable of engaging with an end of the adhesive sheet for winding the adhesive sheet; and a container capable of containing the first rotary shaft and the second rotary shaft and detachably attached to the body of the bookbinding apparatus.

11. The adhesive cartridge to claim 10, further comprising a heating means formed between the first rotary shaft and the second rotary shaft of the container.

* * * * *

UNITED STATES PATENT AND TRADEMARK OFFICE

CERTIFICATE OF CORRECTION

PATENT NO. : 6,637,996 B1 
DATED : October 28, 2003
INVENTOR(S) : Yasuyoshi Hayakawa et al.

It is certified that error appears in the above-identified patent and that said Letters Patent is hereby corrected as shown below:

Column 1,
Line 10, “a” should be deleted.
Line 23, “raise” should read -- arise --.
Line 38, “melt” should read -- melted --.
Lines 47 and 50, “raises” should read -- arises --.

Column 4,
Line 45, “ion” should read -- in --.

Column 5,
Line 57, “heater control unit 21” should read -- heater control unit 221 --.

Column 8,
Line 20, “to” should read -- according to --.

Signed and Sealed this

Sixteenth Day of March, 2004

JON W. DUDAS
*Acting Director of the United States Patent and Trademark Office*